US009463507B2

(12) United States Patent
Miyanaga

(10) Patent No.: US 9,463,507 B2
(45) Date of Patent: Oct. 11, 2016

(54) METHOD FOR PRODUCING HARD TIP

(71) Applicant: KABUSHIKI KAISHA MIYANAGA, Miki-shi (JP)

(72) Inventor: Masaaki Miyanaga, Miki (JP)

(73) Assignee: KABUSHIKI KAISHA MIYANAGA, Miki-shi, Hyogo (JP)

( * ) Notice: Subject to any disclaimer, the term of this patent is extended or adjusted under 35 U.S.C. 154(b) by 445 days.

(21) Appl. No.: 14/081,415

(22) Filed: Nov. 15, 2013

(65) Prior Publication Data

US 2014/0072468 A1 Mar. 13, 2014

Related U.S. Application Data

(62) Division of application No. 12/446,720, filed as application No. PCT/JP2006/323124 on Nov. 20, 2006, now abandoned.

(51) Int. Cl.

| | |
|---|---|
| ***B22F 7/06*** | (2006.01) |
| ***B22F 7/02*** | (2006.01) |
| ***C22C 29/08*** | (2006.01) |
| *B22F 5/00* | (2006.01) |

(52) U.S. Cl.

CPC ..... *B22F 7/02* (2013.01); *B22F 7/064* (2013.01); *C22C 29/08* (2013.01); *B22F 2005/001* (2013.01); *B22F 2999/00* (2013.01); *Y10T 408/78* (2015.01)

(58) Field of Classification Search

None

See application file for complete search history.

(56) References Cited

U.S. PATENT DOCUMENTS

| | | | |
|---|---|---|---|
| 4,398,952 | A | 8/1983 | Drake |
| 4,595,062 | A | 6/1986 | Boyadjieff et al. |

(Continued)

FOREIGN PATENT DOCUMENTS

| | | | |
|---|---|---|---|
| EP | 0 194 018 | A1 | 9/1986 |
| JP | 61-231104 | A | 10/1986 |

(Continued)

OTHER PUBLICATIONS

International Search Report for PCT/JP2006/323124 dated Feb. 20, 2007.

(Continued)

*Primary Examiner* — George Wyszomierski
*Assistant Examiner* — Ngoclan T Mai
(74) *Attorney, Agent, or Firm* — Marshall, Gerstein & Borun LLP

(57) ABSTRACT

The object of the invention is to provide a hard tip where the nose side has wear resistance and the bonding side has toughness. The chemical composition of sintered hard alloy constituting the hard tip is such that a compounding ratio of WC to Co is substantially the same from the nose side to the bonding side, and a first bonding metal or a second bonding metal has a gradient chemical composition wherein the content of the first bonding metal or the second bonding metal is increased from the nose side to the bonding side, the first bonding metal does not form the eutectic texture with WC, and the second bonding metal has the eutectic temperature with WC over the eutectic temperature of WC—Co sintered hard alloy and the melting point over the liquid phase sintering temperature of WC—Co sintered hard alloy.

2 Claims, 23 Drawing Sheets

(56) References Cited

U.S. PATENT DOCUMENTS

| | | | | |
|---|---|---|---|---|
| 5,305,840 | A | 4/1994 | Liang et al. | |
| 5,397,152 | A | 3/1995 | Kawamura | |
| 5,697,042 | A | 12/1997 | Massa et al. | |
| 7,070,643 | B2 | 7/2006 | Kobayashi | |
| 8,277,959 | B2 | 10/2012 | Arvanitidis | |
| 2005/0247491 | A1 | 11/2005 | Mirchandani et al. | |
| 2005/0276717 | A1 | 12/2005 | Fang | |
| 2007/0110607 | A1* | 5/2007 | Iwasaki | C22C 1/051 419/15 |
| 2008/0163723 | A1 | 7/2008 | Mirchandani et al. | |
| 2011/0052931 | A1* | 3/2011 | Morton | C23C 30/005 428/552 |
| 2011/0109020 | A1 | 5/2011 | Iwasaki et al. | |

FOREIGN PATENT DOCUMENTS

| | | | |
|---|---|---|---|
| JP | 62-63005 | A | 9/1994 |
| JP | 8-100589 | A | 4/1996 |
| JP | 8-170482 | A | 7/1996 |
| JP | 09-315873 | | 12/1997 |
| JP | 10-511740 | T | 11/1998 |
| JP | 2006-118033 | A | 5/2006 |

OTHER PUBLICATIONS

Supplementary European Search Report for Application No. EP06832974, dated Nov. 10, 2009.

* cited by examiner bonding side ⟷ nose side

METHOD FOR PRODUCING HARD TIP

CROSS-REFERENCE TO RELATED APPLICATIONS

This is a division of U.S. application Ser. No. 12/446,720 filed Aug. 5, 2009, now abandoned which is the U.S. National Phase of PCT/JP2006/323124 filed Nov. 20, 2006, the entire respective disclosures of which are incorporated herein by reference.

TECHNICAL FIELD

The present invention relates to a hard tip suitable for a cutting edge tip made of sintered hard alloy bonded to the end of the main part of a drill bit by brazing, welding or the like, and the material of the nose of various machining tools and cutting tools such as a tip saw, an weed cutting machine, a saw or the like.

BACKGROUND ART

For example, in order to drill a hole in concrete and stone or the like, it is generally conducted to attach an exclusive drill bit to a rotating hammer drill and simultaneously give a vibratory impact along the axial direction and a rotating torque to the drill bit. In order to satisfy the demand for high efficiency of the drilling work, the steel drill bit, to the end of which a good wear-resistant cutting edge tip made of sintered hard alloy was fixed by brazing, welding or the like, is employed for the drill bit. For example, Japanese patent laid-open application publication No. Hei 7-180463 discloses the following drill: The cutting edge tip has a rectangular section. Main cutters are formed along one diagonal of the end. Auxiliary cutters are formed along the other diagonal of the end. Two main cutters which are opposed to each other form a chisel edge at the top.

The cutting edge tip of the drill bit employs the following constitution to carry out the machining function. A hard metal made of metallic carbide, which has a relatively higher hardness and strength with wear resistance, is mainly employed for the material of the nose. A bonding metal such as cobalt or the like which has a relatively lower hardness with toughness, is mainly employed for the material of the bonding side which bonds the cutting edge tip to the main part of the drill bit. That is, the material of the nose side of the cutting edge tip is needed to have wear resistance, and the material of the bonding side of the cutting edge tip is needed to contain much material which is easily bonded to the other material and have a near coefficient of thermal expansion to that of the other material. Thus, the different properties are necessary for the nose side and the bonding side of the cutting edge tip to be bonded to the end of the drill bit.

Japanese Patent laid-open application publication No. Hei 8-100589 discloses the following drill bit: The drill bit consists of a bit head which forms a contact surface with rock surface or rocky mountain and a stem portion which is an attachment part to a device. The bit head consists of a head tip portion and a fitting portion which is integrally fusion-welded with the base of the head tip portion and fitted to the stem portion. The head tip portion is harder than the fitting portion and the hardness of the head tip portion made of sintered hard alloy is gardient so that the hardness of the end is higher than the base.

Japanese Patent laid-open application publication No. Hei 8-170482 discloses the following drill bit: The drill bit consists of a head tip portion which plays a leading role in the drilling work to rock surface or rocky mountain and a shank portion which is an attachment part to a device. The head tip portion is integrally fusion-welded with the shank portion. The hardness of the head tip portion made of sintered hard alloy is gardient so that the hardness of the end is higher than the base adjacent to the shank portion.

Japanese Patent laid-open application publication No. 2006-118033 discloses a method for producing a sintered body having a gradient chemical composition by pulse charging sintering.

Japanese Patent publication No. Hei 10-511740 based on an international application and Japanese Patent laid-open application publication No. Sho 61-231104 disclose the following metallic product: The metallic product consists of first portion and second portion. The first portion comprises wear-resistant coarse metallic particles and the second portion comprises wear-resistant fine metallic particles. The bonding metal content of the first portion is small and the bonding metal content of the second portion is large.

DISCLOSURE OF INVENTION

Problems to be Solved by the Invention

The disclosure of the prior art described above have the following disadvantages.

The method for producing the drill bit by an electrical discharge plasma sintering process is described in JP8-100589. As shown in FIG. 23(*a*), WC—Co powder 22 containing cobalt by ten percent of weight is filled into a sintering die 21 of an electrical discharge plasma sintering machine having a forming surface corresponding to the shape of the head tip portion by necessary quantity. Next, as shown in FIG. 23(*b*), WC—Co powder 23 containing cobalt by twenty five percent of weight is placed on the powder 22 by necessary quantity. Furthermore, as shown in FIG. 23(*c*), an end flange 25 of a fitting material 24 cut off from carbon steel bar is brought into contact with the upper surface of the powder 23, pressure is added to the fitting material 24 from above and the sintering die 21 is put in between the electrodes of the electrical discharge plasma sintering machine to add pulse voltage. By this electrical discharge plasma sintering process, the electrical discharge plasma with extremely high temperature is generated at mutual contact points of powder particles when pulse voltage is added, powder is instantaneously heated by the electrical discharge, and the powder particles are sintered one another by fusion welding. Passages 0012 and 0013 of JP8-170482 also state that the drill bit is produced by the electrical discharge plasma sintering process. The electrical discharge plasma sintering process set forth in the JP8-00589 and JP8-170482 has a short sintering time but the constitution of the electrical discharge plasma sintering machine is complicated and the process extremely increase the cost of production. Furthermore, the troublesome machine handling is necessary and the process is not suitable for mass production.

A short time heating (rapid rising in temperature) is conducted in the pulse charging sintering disclosed in JP2006-118033. In this case, the same sintering temperature cannot be obtained at the plane perpendicular to the pulse charging direction and the temperature of the outer circumference is lower than the center. As a result, the outer circumference is not sufficiently sintered or the center is excessively sintered and the ingredients are fused out.

Furthermore, as the diameter of metallic particles becomes finer, the hardness tends to rise. On the other hand, as the diameter of metallic particles becomes coarser, the hardness tends to lower. As the content of the bonding metal becomes larger, the hardness tends to lower. On the other hand, as the content of the bonding metal becomes smaller, the hardness tends to rise. In this point, in the metallic product according to JP10-511740 and JP61-231104, as the diameter of metallic particles of the first portion is coarse, the hardness ought to lower, and as the diameter of metallic particles of the second portion is fine, the hardness ought to rise. But, as the second portion includes a large amount of the bonding metal which tends to make the hardness lower, the hardness of the second portion does not become so much high. Accordingly, it is not possible to employ the first portion as well as the second portion as the material of the nose side of the cutting edge tip for the drill bit.

When a cutting edge tip made of sintered hard alloy is bonded to a drill bit made of special steel by brazing or welding, a complex residual stress is created at the bonding point of the cutting edge tip and the main part of the drill bit because of the difference of coefficient of thermal expansion between the cutting edge tip and the main part of the drill bit having different chemical components each other. For this reason, when the bonding side of the cutting edge tip is not provided with toughness, the cutting edge tip is liable to be damaged. Even if the damage is not done at the time of the bonding, there is a possibility of the cutting edge tip coming off the drill bit in the actual drilling work when the bonding side of the cutting edge tip is not provided with toughness. The reason is because the complex residual stress is created at the bonding point of the cutting edge tip and the main part of the drill bit due to the difference of coefficient of thermal expansion between the cutting edge tip and the main part of the drill bit having different chemical components each other.

The foregoing is stated in the case that the hard tip of the present invention was applied to the cutting edge tip at the end of the drill bit. There is a common demand for the material of the nose of various machining tools and cutting tools such as a tip saw, an weed cutting machine, a saw or the like as well as a drill bit. That is, the ens of the material of the nose is requested to provide with wear resistance and the bonding side for bonding the nose to the main part is requested to include a lot of the material which is easily bonded to the main part and have a near coefficient of thermal expansion to that of the main part. Thus, it is requested to mass-produce industrially a hard tip where the nose side and the bonding side have the different properties respectively.

In view of the foregoing, the object of the invention is to provide a hard tip where the nose side have wear resistance and the bonding side have toughness, and a method for producing simply and inexpensively the hard tip where the hard tip of the nose side is not damaged or does not come off when the hard tip is bonded to the main part of machining tools and cutting tools and those tools are in use.

Means for Solving the Problems

The present inventor has done the earnest research in order to achieve the above object. As a result, the present inventor has attained to perfection of the invention wherein a hard tip of gradient chemical composition, in which the nose side have wear resistance and the bonding side have toughness, can be simply produced, as described below.

That is, a vacuum sintering (sintering under a lower pressure than atmospheric pressure (1013 hectopascals)) which is relatively inexpensive is suitable for mass production. But, it is needed to maintain a sintering temperature (approximately 1350 to 1450° C.) for 30 to 60 minutes. Accordingly, long time is necessary for completion of the vacuum sintering. Therefore, when the hard tip of gradient chemical composition, in which the nose side has good wear resistance and the bonding side have good toughness, is produced by the vacuum sintering, the elements constituting the gradient chemical composition diffuse one another during long time sintering process and the chemical composition is homogenized. So, it is not possible to maintain the gradient chemical composition.

Well, as shown in FIG. 22, WC—Co (tungsten carbide) sintered hard alloy forms the eutectic texture and the liquid phase sintering of WC—Co sintered hard alloy can be done at a temperature of melting point (1490° C.) or less of cobalt. Therefore, if a first metal or a second metal comprising the following features are utilized, the required effects can be achieved. The first metal is characterized in that it does not form the eutectic texture with WC. The second metal is characterized in that it has the eutectic temperature with WC over the eutectic temperature of WC—Co sintered hard alloy and the melting point over the liquid phase sintering temperature of WC—Co sintered hard alloy. Accordingly, if the first metal or the second metal is added to WC—Co sintered hard alloy, it is possible for the first metal or the second metal to keep the same composition as added under the state of solid or the half fusion.

The present invention is directed to a hard tip consisting of block made of WC—Co sintered hard alloy wherein the chemical composition of sintered hard alloy constituting the hard tip is characterized in that a compounding ratio of WC to Co is substantially the same from a nose side to a bonding side, a first bonding metal or a second bonding metal has a gradient chemical composition wherein the content of the first bonding metal or the second bonding metal is increased from the nose side to the bonding side, the first bonding metal does not form the eutectic texture with WC, and the second bonding metal has the eutectic temperature with WC over the eutectic temperature of WC—Co sintered hard alloy and the melting point over the liquid phase sintering temperature of WCCo sintered hard alloy.

As described above, the hard tip of the present invention has an important feature that a compounding ratio of WC to Co is substantially the same from a nose side to a bonding side, a first bonding metal or a second bonding metal has a gradient chemical composition wherein the content of the first bonding metal or the second bonding metal is increased from the nose side to the bonding side, the first bonding metal does not form the eutectic texture with WC, and the second bonding metal has the eutectic temperature with WC over the eutectic temperature of WC—Co sintered hard alloy and the melting point over the liquid phase sintering temperature of WC—Co sintered hard alloy. As a result, in comparison with WC (tungsten carbide) which carries out the function of wear resistance, the content of Co (cobalt) and bonding metal which carries out the function as binder is small at the nose side and large at the bonding side. Therefore, it is possible to provide a hard tip of ideal properties where the nose side has high hardness as well as wear resistance and the bonding side has low hardness as well as toughness.

It is premised that the content of WC is within the range of 75 parts by weight or more to 95 parts by weight or less, the content of Co is within the range of 5 parts by weight or more to 25 parts by weight or less, and the sum of WC and Co is 100 parts by weight. In the above range, it is preferable that the compounding ratio of WC to Co is substantially the same from the nose side to the bonding side. Furthermore, in case that the sum of WC and Co is 75 percent by weight or more, 25 percent by weight or less is a bonding metal which has the eutectic temperature with WC over the eutectic temperature of WC—Co sintered hard alloy and the melting point over the liquid phase sintering temperature of WC—Co sintered hard alloy from the nose side to the bonding side, and the bonding metal has preferably the following features. The bonding metal has a gradient chemical composition wherein the content is increased from the nose side to the bonding side. The hard tip having the above chemical composition can be preferably employed as a cutting edge tip bonded to the end of a drill bit for drilling concrete, for example.

The metals below are examples of the bonding metal which has the eutectic temperature with WC over the eutectic temperature (1280° C.) of WC—Co sintered hard alloy and the melting point over the liquid phase sintering temperature (1400° C.) of WC—Co sintered hard alloy. Relatively ductile Ni (nickel) which has the melting point of 1450° C. and the Young's modulus of $207\times10^9$ N/m$^2$ or relatively ductile Cr (chromium) which has the melting point of 1860° C. and the Young's modulus of $249\times10^9$ N/m$^2$ can be preferably used as the bonding metals.

The present invention relates to a method for producing a hard tip where a compounding ratio of WC to Co is substantially the same at each layer from the nose layer of a nose side to the bonding layer of a bonding side via intermediate layer(s) of one or more, a first bonding metal or a second bonding metal has a gradient chemical composition wherein the content of the first bonding metal or the second bonding metal is increased from the nose side to the bonding side, the first bonding metal does not form the eutectic texture with WC, and the second bonding metal has the eutectic temperature with WC over the eutectic temperature of WC—Co sintered hard alloy and the melting point over the liquid phase sintering temperature of WC—Co sintered hard alloy. The method for producing the above hard tip comprises the following processes of a first process, a second process, a third process and a fourth process, a first process being a stage of feeding, sintered hard alloy powder for the nose layer comprising a required compounding ratio of WC to Co and a smallest quantity of a bonding metal, into a compacting mold for the hard tip, a second process being a stage of layering, sintered hard alloy powder for intermediate layer(s) of one or more comprising a required compounding ratio of WC to Co and the bonding metal whose content is gradually increasing compared with the nose layer, upon the nose layer in the compacting mold for the hard tip, a third process being a stage of layering, sintered hard alloy powder for the bonding layer comprising a required compounding ratio of WC to Co and a largest quantity of the bonding metal, upon the intermediate layer(s) in the compacting mold for the hard tip and adding pressure to obtain a compact (article obtained by compressing powder), and a fourth process being a stage of putting the compact in a heating furnace and sintering at a temperature of melting point or less of the bonding metal and a lower pressure than atmospheric pressure to produce the hard tip.

Thus, the method for producing a hard tip by the present invention makes skillful use of the chemical action, where a required compounding ratio of WC to Co forms the eutectic texture but a special bonding metal is difficult to form the eutectic texture. The special bonding metal has the eutectic temperature with WC over the eutectic temperature of WC—Co sintered hard alloy and the melting point over the liquid phase sintering temperature of WC—Co sintered hard alloy. In accordance with the present invention, it is possible to produce a hard tip where a compounding ratio of WC to Co is substantially the same from the nose layer to the bonding layer, a first bonding metal or a second bonding metal has a gradient chemical composition wherein the content of the first bonding metal or the second bonding metal is increased from the nose layer to the bonding layer, the first bonding metal does not form the eutectic texture with WC, and the second bonding metal has the eutectic temperature with WC over the eutectic temperature of WC—Co sintered hard alloy and the melting point over the liquid phase sintering temperature of WC—Co sintered hard alloy. Accordingly, it is possible to provide the hard tip where the nose side has high hardness as well as wear resistance and the bonding side has low hardness as well as toughness. As a result, it is possible to prevent an undesirable situation. That is, when the hard tip is bonded to a machining tool or a cutting tool by brazing or welding or the like and the tool to which the hard tip was bonded is in use, a residual stress is liable to be produced at the bonding part of the hard tip and the machining tool or the cutting tool because of the difference of coefficient of thermal expansion between the hard tip and the above tool having different chemical components. But, since the residual stress is vanished so that the ductile bonding layer with toughness is elastically deformed correspondingly to the residual stress, the hard tip is not damaged or does not come off at the time of the bonding or in the actual use.

Effects of the Invention

Since the present invention is constituted as described above, it is possible to provide a hard tip where the nose side has wear resistance and the bonding side has toughness, and an inexpensive and simple method for producing a hard tip where the hard tip which is the material of the nose is not be damaged or does not come off when the hard tip is bonded to a machining tool or a cutting tool and the tool to which the hard tip was bonded is in use.

EXPLANATION OF NUMERALS

Figure 1:
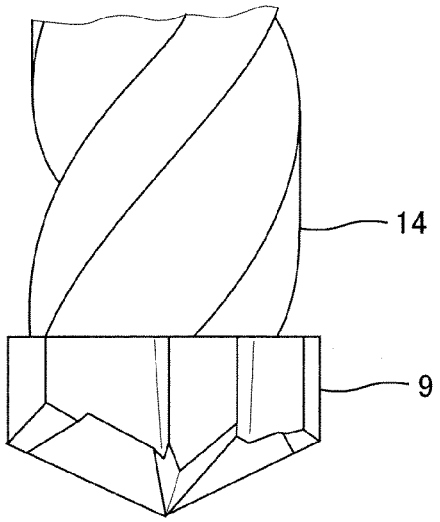
FIG. 1 is a front view showing the important part of a drill bit whose part is omitted, wherein a cutting edge tip as an embodiment of the hard tip of the present invention was bonded to the end thereof.

1 compacting mold
2 upper punch
3 lower punch
4 die
5 nose layer
6 first intermediate layer
7 second intermediate layer
8 bonding layer
9 cutting edge tip
10 nose side
11 bonding side
12 major cutting edge
13 minor cutting edge
14 main part of bit

BEST MODE FOR CARRYING OUT THE INVENTION

The following description of the best mode for carrying out the invention should be read with reference to the drawings wherein reference numerals indicate elements throughout plural views. The detailed description and drawings illustrate examples of various embodiments of the claimed invention, and are not intended to be limiting. It is possible to alter or modify it properly without deviating from the extent of the present invention.

(1) The First Embodiment

Figure 2:
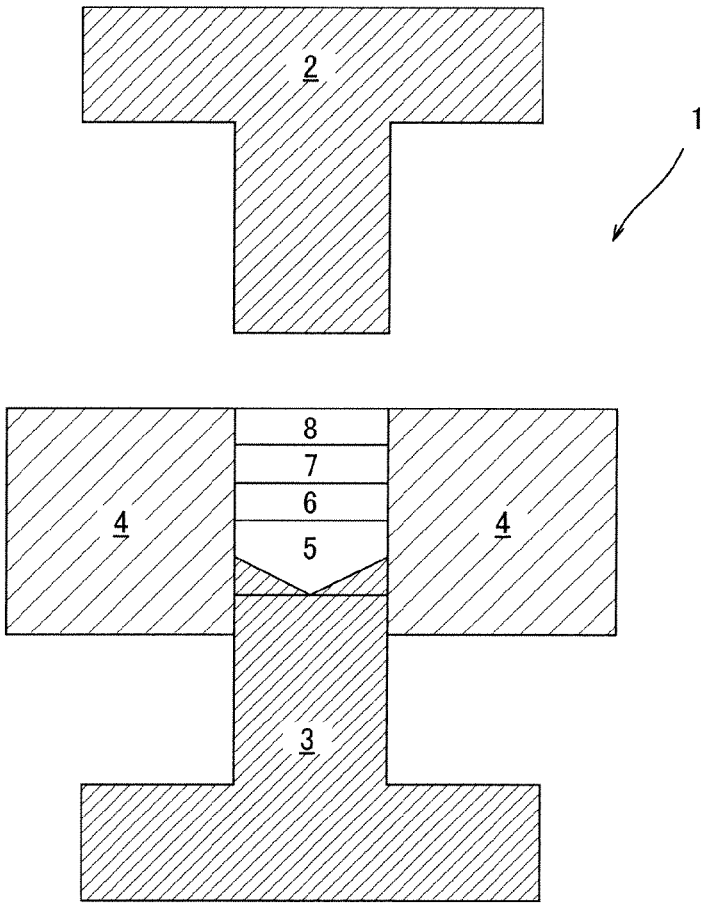
FIG. 2 is a schematic section view showing an example of a compacting mold for the hard tip and a layered compact.

The powder comprising WC (tungsten carbide) powder of 85 percent by weight of the average particle diameter of 0.2 μm and Co (cobalt) powder of 15 percent by weight of the average particle diameter of 1.25 μm was uniformly mixed to get a first mixed powder for a nose layer. As shown in FIG. 2, the first mixed powder was fed into compacting mold 1 consisting of upper punch 2, lower punch 3 and die 4 to obtain a nose layer 5. Next, the powder comprising WC—Co powder of 98 percent by weight consisting of the above WC powder of 85 parts by weight and the above Co powder of 15 parts by weight and Ni (nickel) powder of 2 percent by weight of the average particle diameter of 5.0 μm was uniformly mixed to get a second mixed powder for a first intermediate layer. The second mixed powder was layered upon the nose layer 5 to obtain a first intermediate layer 6. And the powder comprising WC—Co powder of 95 percent by weight consisting of the above WC powder of 85 parts by weight and the above Co powder of 15 parts by weight and the above Ni powder of 5 percent by weight was uniformly mixed to get a third mixed powder for a second intermediate layer. The third mixed powder was layered upon the first intermediate layer 6 to obtain a second intermediate layer 7. Further, the powder comprising WC—Co powder of 92 percent by weight consisting of the above WC powder of 85 parts by weight and the above Co powder of 15 parts by weight and the above Ni powder of 8 percent by weight was uniformly mixed to get a fourth mixed powder for a bonding layer. The fourth mixed powder was layered upon the second intermediate layer 7 to obtain a bonding layer 8.

Figure 21:
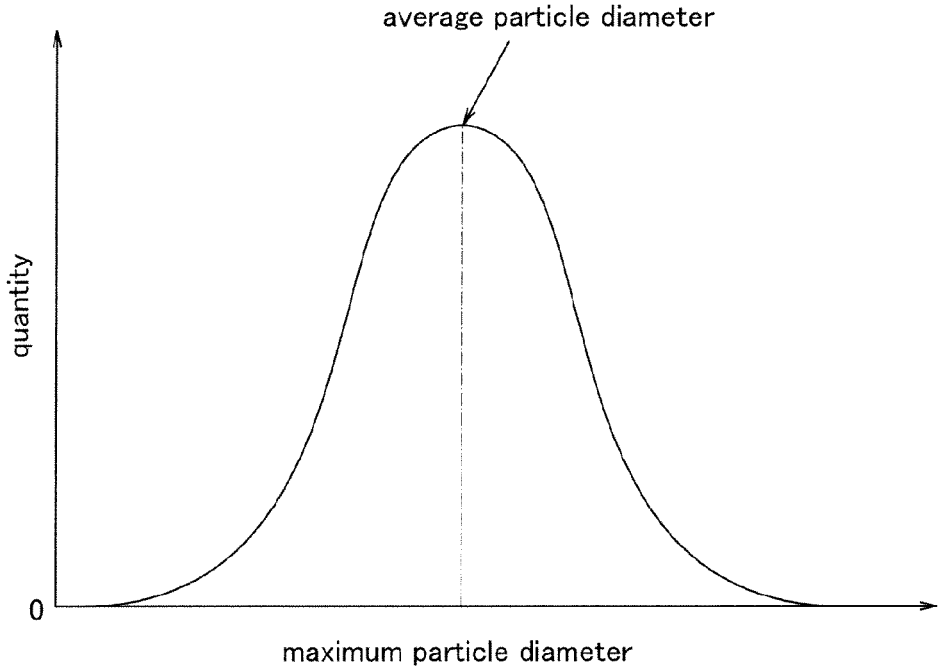
FIG. 21 is a view illustrating the average particle diameter in this description.
Figure 22:
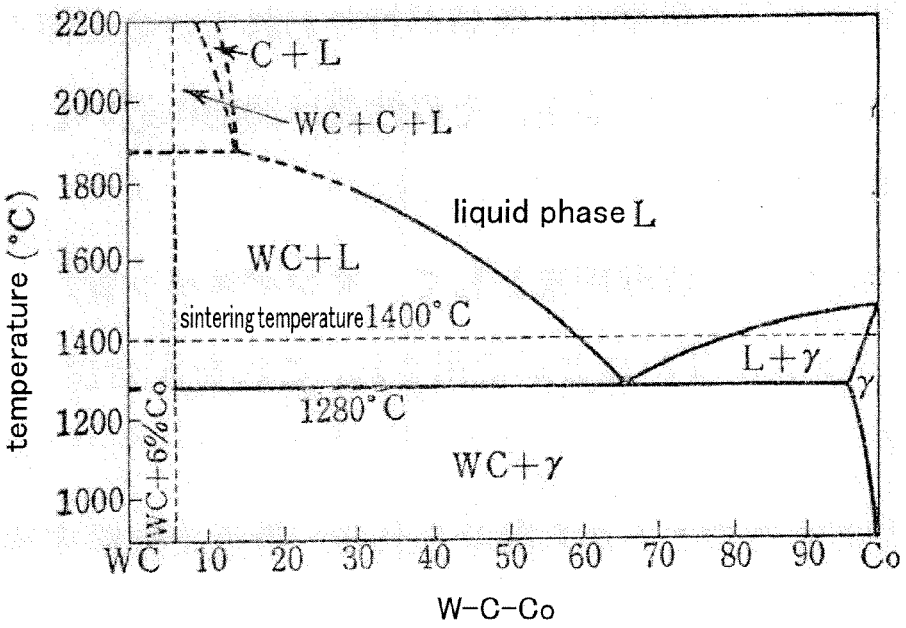
FIG. 22 is a view showing the phase diagram of W—C—Co ternary elements.
Figure 23:
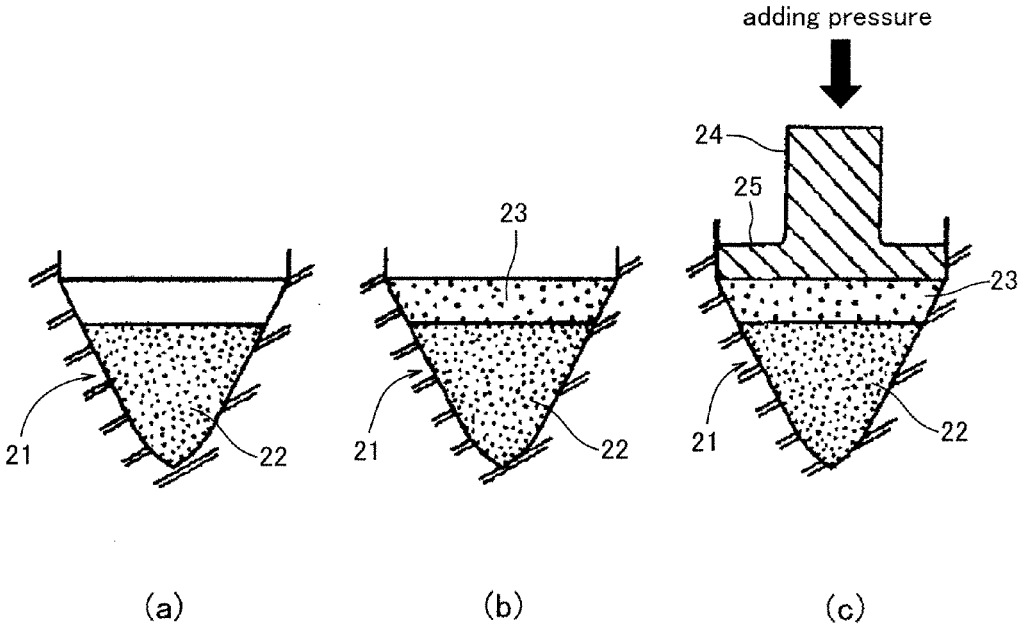
Fig. 23 PRIOR ART
FIGS. 23(*a*) to (*c*) are views showing sintering processes of the bit head of the prior method for producing a drill bit.

The layered article comprising the nose layer 5, the first intermediate layer 6, the second intermediate layer 7 and the bonding layer 8 was added pressure by the upper punch 2 from above to produce a layered compact whose chemical composition is gradient along the direction of height. As described above, the layered compact (compact consisting of two or more layers whose chemical composition are different one another) was produced. In the first embodiment and the other embodiments as described below, the meaning of the average particle diameter of powder will be given below. As shown in FIG. 21, in case that the abscissa denotes the maximum particle diameter of powder and the ordinate denotes the quantity of powder, the average particle diameter of powder indicates the particle diameter of powder whose quantity is most. In the first embodiment, a layered compact whose chemical composition is gradient along the direction of height was produced by layering in order of the first intermediate layer, the second intermediate layer and the bonding layer upon the nose layer. But, in reverse order, that is, it is possible to produce a layered compact whose chemical composition is gradient along the direction of height by layering in order of the second intermediate layer, the first intermediate layer and the nose layer upon the bonding layer.

The above layered compact was put in a vacuum heating furnace (not shown). The pressure in the vacuum heating furnace was reduced to 200 Pa and heated up to the temperature of 1400° C. The layered compact was sintered at the temperature of 1400° C. for 40 minutes and the pressure of 200 Pa. The sintering which is carried out under a lower pressure than atmospheric pressure (1013 hectopascals) is generally called vacuum sintering. The heating was carried out under nitrogen gas condition to prevent the oxidation of the material.

Figure 3:
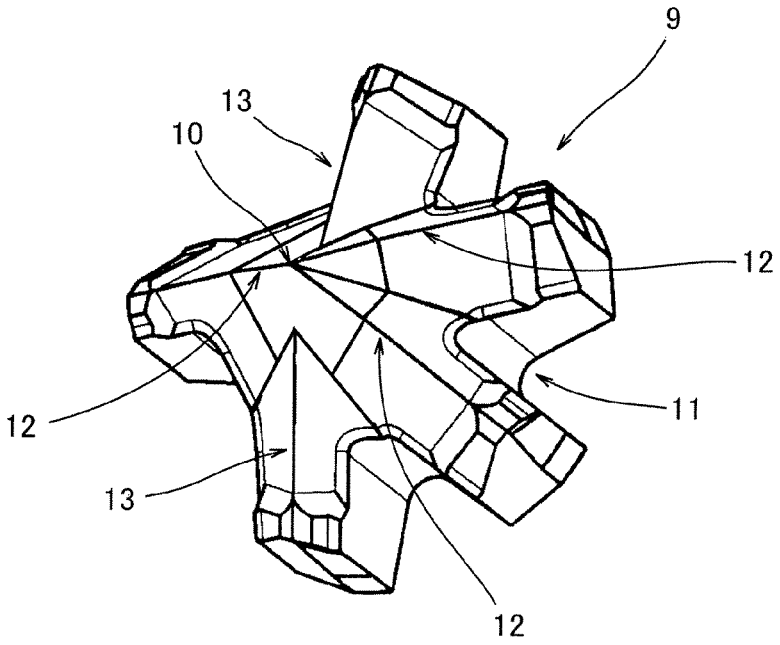
FIG. 3 is a perspective view showing a cutting edge tip for a drill bit as an embodiment of the hard tip of the present invention.
Figure 4:
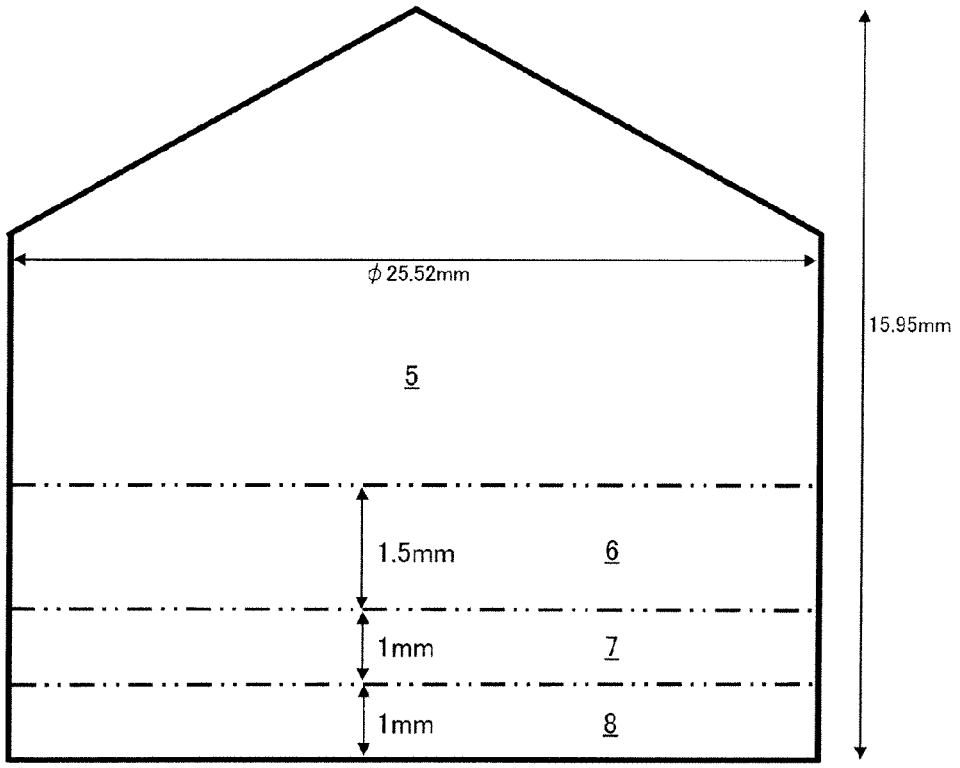
FIG. 4 is a schematic view showing the thickness of each layer of a cutting edge tip as an embodiment of the present invention.

A cutting edge tip 9 as shown in FIG. 3 was obtained by the above vacuum sintering. FIG. 4 is a schematic view showing the thickness of each layer of the cutting edge tip 9 obtained as described above.

Figure 5:
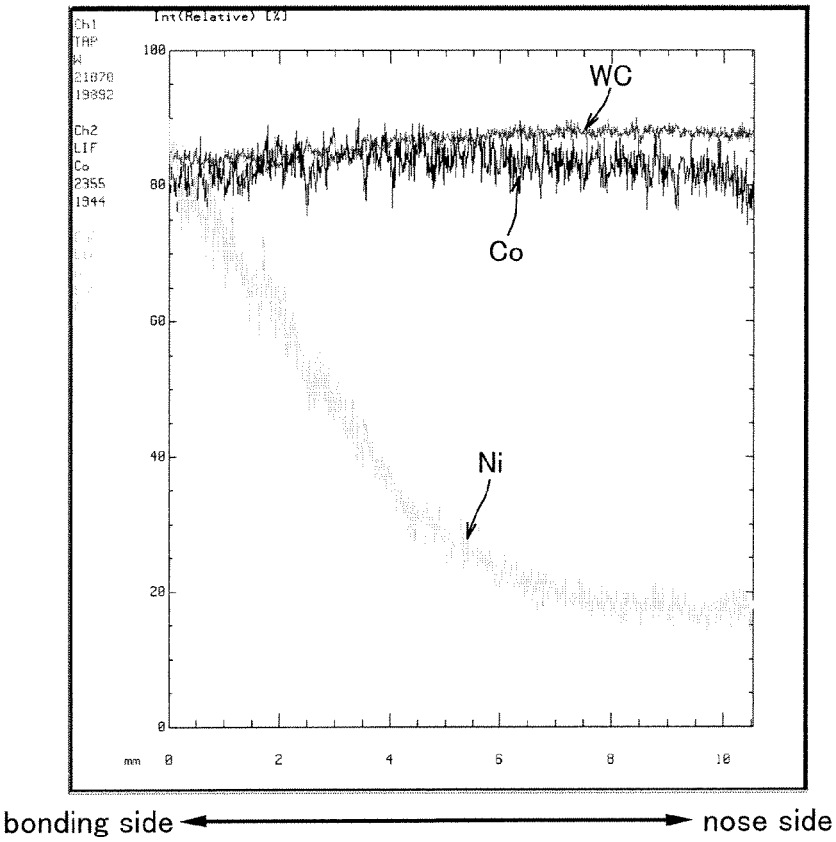
FIG. 5 is a view showing the concentration distribution of component elements of a cutting edge tip as an embodiment of the present invention from the nose side to the bonding side.

FIG. 5 is a view showing the concentration distribution of component elements of the cutting edge tip 9 shown in FIG. 3 from the sharp tip (the nose side) 10 to the bottom (the bonding side) 11 which was measured by a scanning electron microscope. The content of WC (tungsten carbide) is increased a little from the bonding side to the nose side. But a compounding ratio of WC to Co is nearly the same from the nose side to the bonding side. Nickel shows a gradient chemical composition where the content is increased from the nose side to the bonding side.

Figure 6:
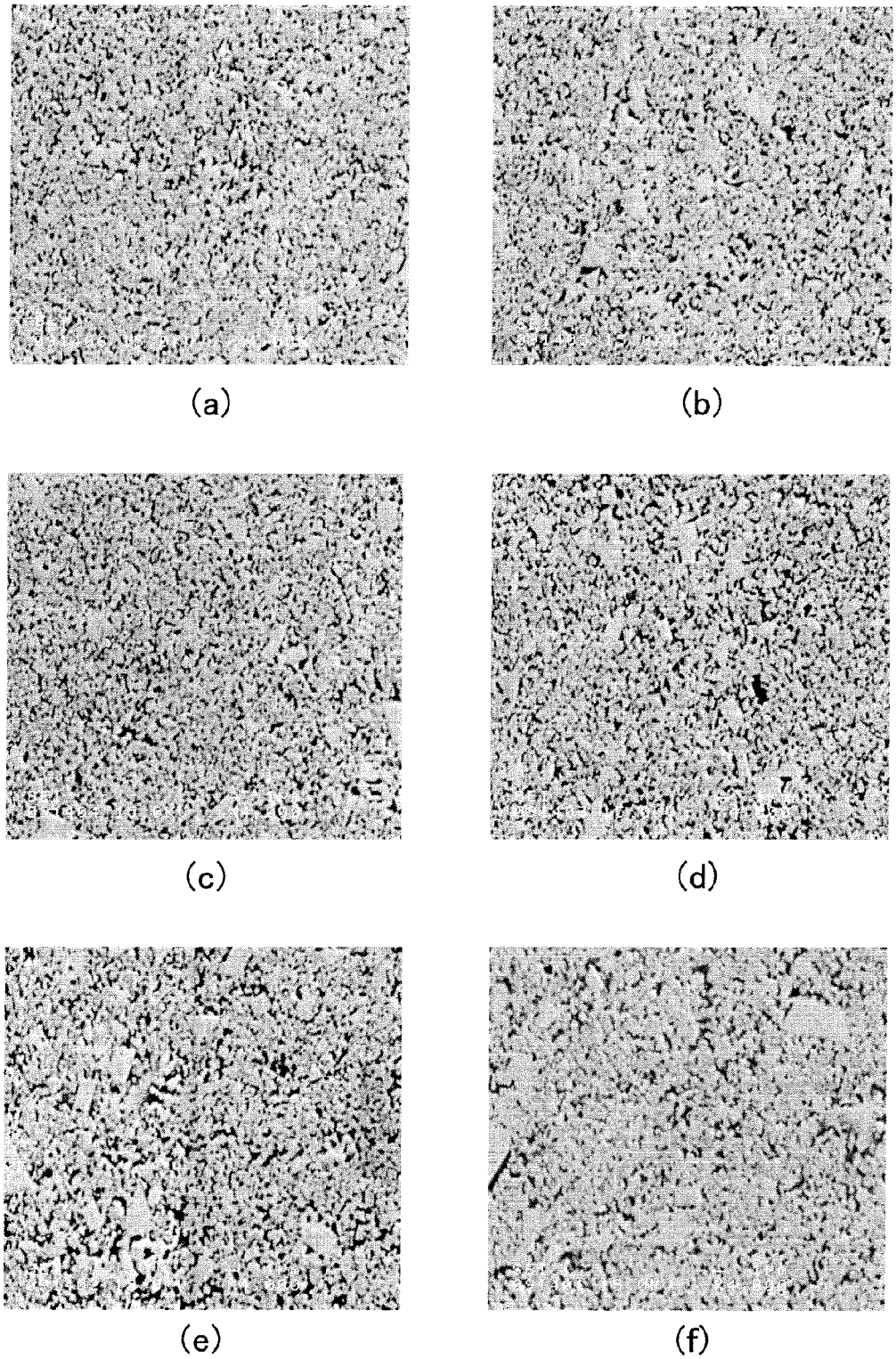
FIGS. 6(*a*) to (*f*) are views showing microscope photos at various parts of the outer circumference of the major cutting edge of a cutting edge tip as an embodiment of the present invention from the bottom to the nose.
Figure 7:
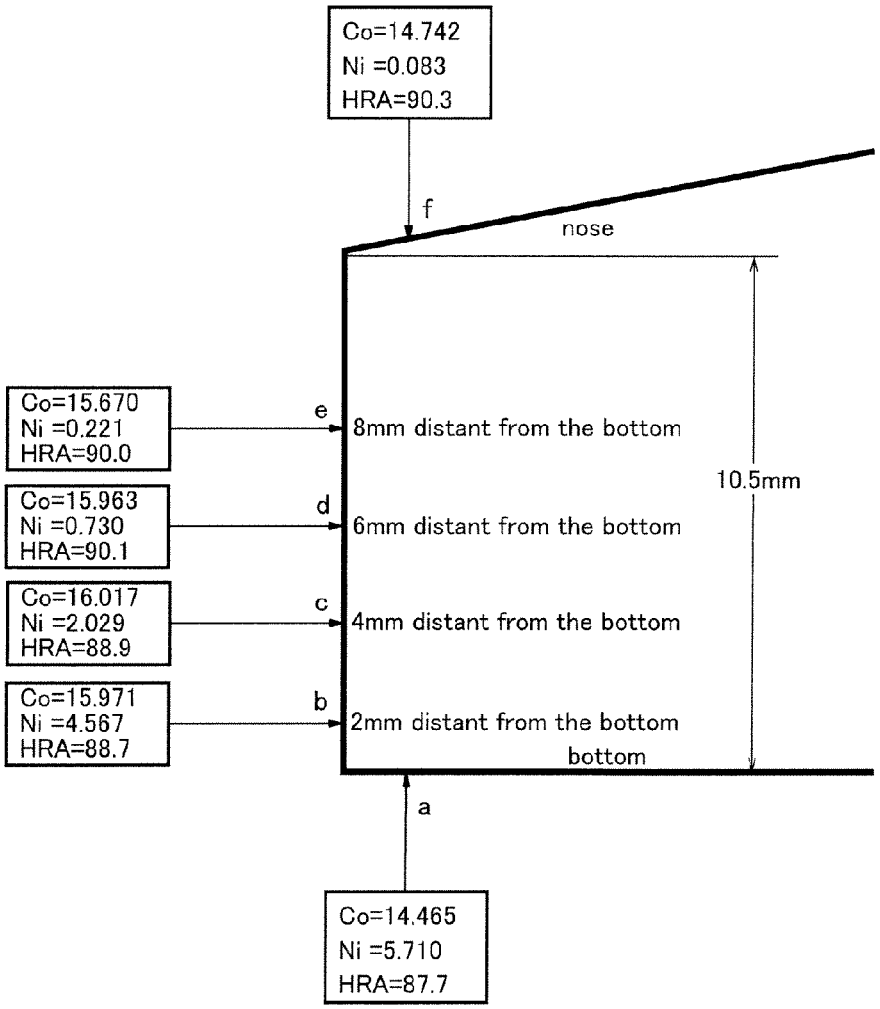
FIG. 7 is a view showing cobalt concentration (percent by weight), nickel concentration (percent by weight) and Rockwell hardness (HRA) at various parts of the outer circumference of the major cutting edge of a cutting edge tip as an embodiment of the present invention from the bottom to the nose.

FIG. 6(*a*) is a view showing a 4000-power microscope photo of the nose (see FIG. 7, "f") of a major cutting edge 12 of the cutting edge tip 9 shown in FIG. 3. FIG. 6(*b*) is a view showing a '4000-power microscope photo at 8 mm above the bottom (see FIG. 7, "e") of a major cutting edge 12. FIG. 6(*c*) is a view showing a 4000-power microscope photo at 6 mm above the bottom (see FIG. 7, "d") of a major cutting edge 12. FIG. 6(*d*) is a view showing a 4000-power microscope photo at 4 mm above the bottom (see FIG. 7, "c") of a major cutting edge 12. FIG. 6(*e*) is a view showing a 4000-power microscope photo at 2 mm above the bottom (see FIG. 7, "b") of a major cutting edge 12. FIG. 6(*f*) is a view showing a 4000-power microscope photo of the bottom (see FIG. 7, "a") of a major cutting edge 12. As shown in microscope photos of FIGS. 6(*a*) to (*f*), the sintered texture is satisfactorily fine without coarse inclusion FIG. 7 is a view showing cobalt concentration (percent by weight), nickel concentration (percent by weight) and Rockwell hardness (HRA) at various parts "a" to "f" of the outer circumference of the major cutting edge 12 of the cutting edge tip 9 shown in FIG. 3 from the bottom to the nose. As shown in FIG. 7, the nose side where the content of the bonding metal (Co and Ni) is small is hard but the bottom (the bonding side) where the content of the bonding metal (Co and Ni) is large is soft. Thus, FIG. 7 shows the hardness distribution suitable for machining function required to the cutting edge tip.

(2) The Second Embodiment

As the second embodiment, the layered compact, which consists of four layers comprising the nose layer, the first intermediate layer, the second intermediate layer and the bonding layer with the same compounding ratio as the first embodiment, was produced by the same condition as the first embodiment. The above layered compact was put in a vacuum heating furnace (not shown). The pressure in the vacuum heating furnace was reduced to 200 Pa and heated up to the temperature of 1470° C. The layered compact was sintered at the temperature of 1470° C. for 40 minutes and the pressure of 200 Pa. The vacuum sintering was carried out like this. The heating was carried out under nitrogen gas condition to prevent the oxidation of the material.

Figure 8:
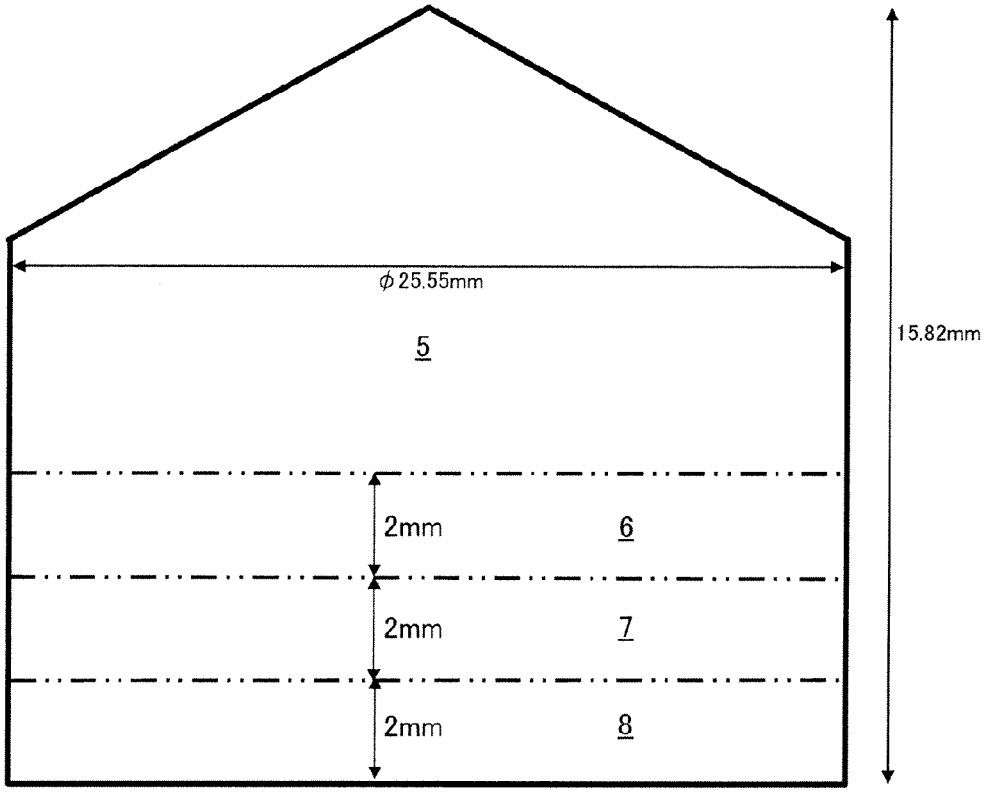
FIG. 8 is a schematic view showing the thickness of each layer of a cutting edge tip as another embodiment of the present invention.

A cutting edge tip 9 as shown in FIG. 3 was obtained by the above vacuum sintering. FIG. 8 is a schematic view showing the thickness of each layer of the cutting edge tip 9 obtained as described above.

Figure 9:
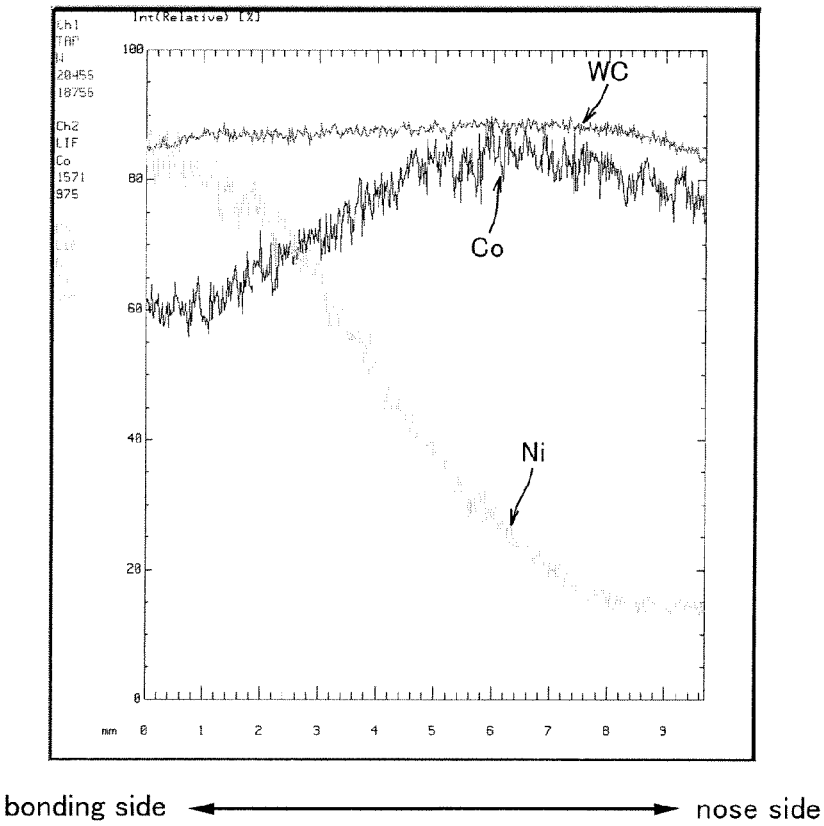
FIG. 9 is a view showing the concentration distribution of component elements of a cutting edge tip as another embodiment of the present invention from the nose side to the bonding side.
Figure 10:
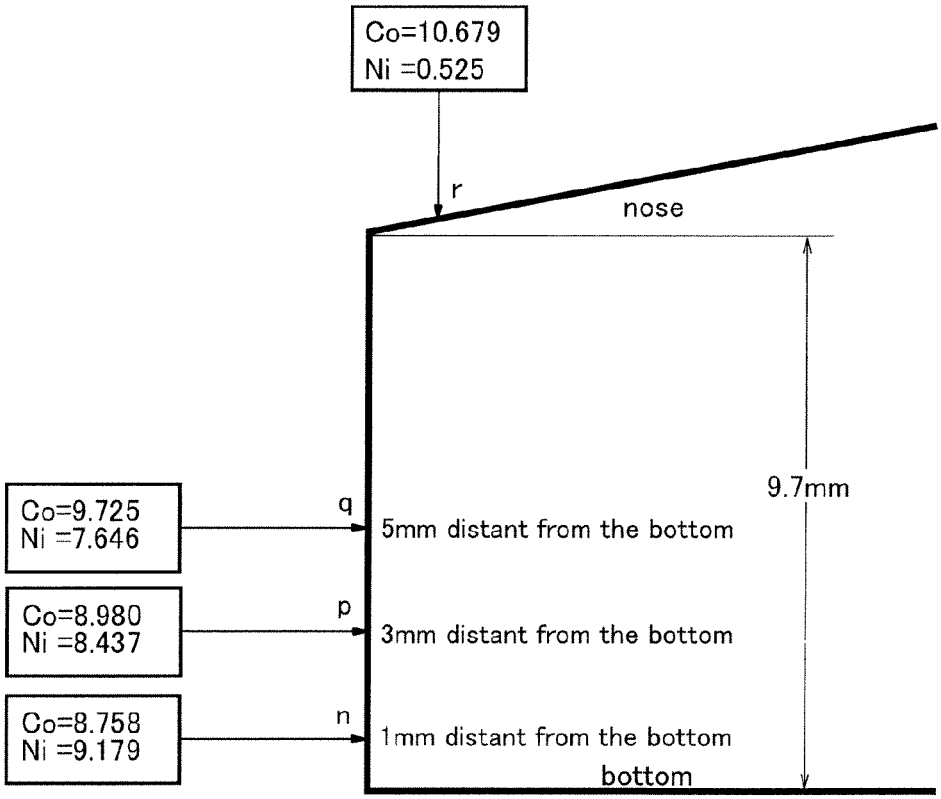
FIG. 10 is a view showing cobalt concentration (percent by weight) and nickel concentration (percent by weight) at various parts of the outer circumference of the major cutting edge of a cutting edge tip as another embodiment of the present invention from the bottom to the nose.

FIG. 9 is a view showing the concentration distribution of component elements of the cutting edge tip obtained as described above from the sharp tip (the nose side) to the bottom (the bonding side) which was measured by a scanning electron microscope. Nickel shows a gradient chemical composition where the content is increased from the nose side to the bonding side. FIG. 10 shows cobalt concentration (percent by weight) and nickel concentration (percent by weight) at various parts "n" to 46/7 of the outer circumference of the major cutting edge of the cutting edge tip from the bottom to the nose. As shown in FIG. 10, nickel concentration (percent by weight) at the nose is more than 0.5 percent by weight.

Thus, since nickel diffuses toward the nose by sintering at the temperature over the melting point of nickel, the hardness of the nose side tends to lower.

(3) The Third Embodiment

The powder comprising WC (tungsten carbide) powder of 90 percent by weight of the average particle diameter of 0.9 μm and Co (cobalt) powder of 10 percent by weight of the average particle diameter of 1.25 μm was uniformly mixed to get a first mixed powder for a nose layer. As shown in FIG. 2, the first mixed powder was fed into the compacting mold 1 consisting of the upper punch 2, the lower punch 3 and the die 4 to obtain a nose layer 5. Next, the powder comprising WC—Co powder of 95 percent by weight consisting of the above WC powder of 90 parts by weight and the above Co powder of 10 parts by weight and Ni (nickel) powder of 5 percent by weight of the average particle diameter of 5.0 μm was uniformly mixed to get a second mixed powder for a first intermediate layer. The second mixed powder was layered upon the nose layer 5 to obtain a first intermediate layer 6. And the powder comprising WC—Co powder of 90 percent by weight consisting of the above WC powder of 90 parts by weight and the above Co powder of 10 parts by weight and the above Ni powder of 10 percent by weight was uniformly mixed to get a third mixed powder for a second intermediate layer. The third mixed powder was layered upon the first intermediate layer 6 to obtain a second intermediate layer 7. Further, the powder comprising WC—Co powder of 85 percent by weight consisting of the above WC powder of 90 parts by weight and the above Co powder of 10 parts by weight and the above Ni powder of 15 percent by weight was uniformly mixed to get a fourth mixed powder for a bonding layer. The fourth mixed powder was layered upon the second intermediate layer 7 to obtain a bonding layer 8.

The layered article comprising the nose layer 5, the first intermediate layer 6, the second intermediate layer 7 and the bonding layer 8 was added pressure by the upper punch 2 from above to produce a layered compact whose chemical composition is gradient along the direction of height. As described above, the layered compact was produced.

Next, the above layered compact was put in a vacuum heating furnace (not shown). The pressure in the vacuum heating furnace was reduced to 200 Pa and heated up to the temperature of 1550° C. The layered compact was sintered at the temperature of 1550° C. for 40 minutes and the pressure of 200 Pa. The vacuum sintering was carried out like this. The heating was carried out under nitrogen gas condition to prevent the oxidation of the material.

Figure 11:
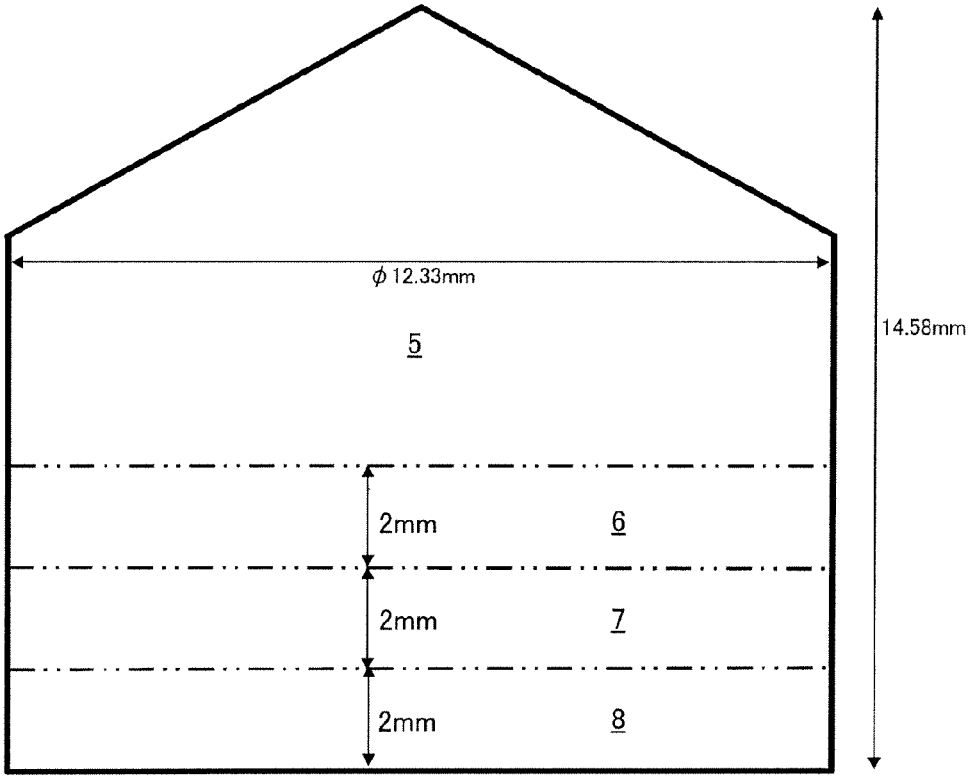
FIG. 11 is a schematic view showing the thickness of each layer of a cutting edge tip as further another embodiment of the present invention.

A cutting edge tip 9 as shown in FIG. 3 was obtained by the above vacuum sintering. FIG. 11 is a schematic view showing the thickness of each layer of the cutting edge tip 9 obtained as described above.

Figure 12:
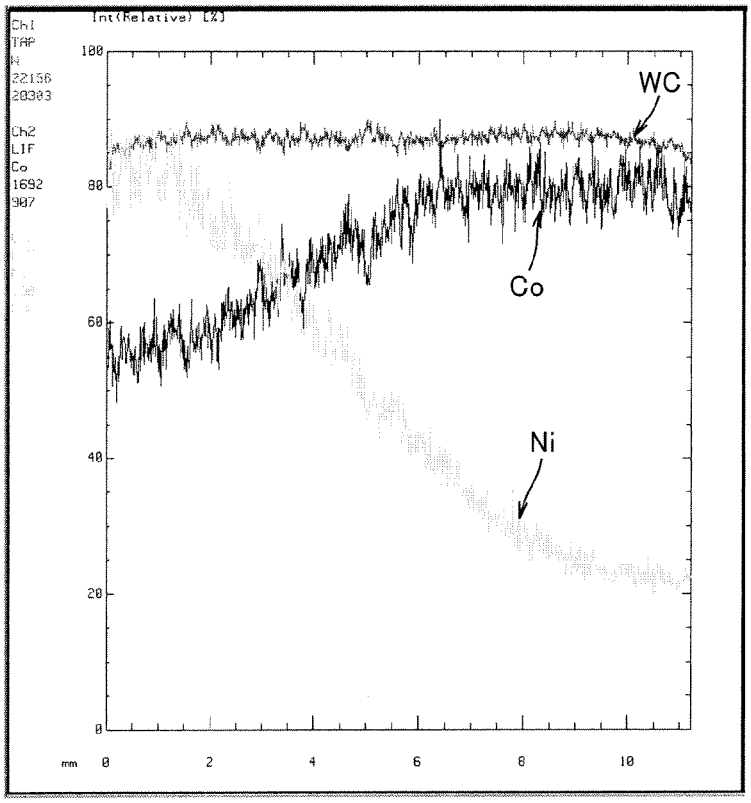
FIG. 12 is a view showing the concentration distribution of component elements of a cutting edge tip as further another embodiment of the present invention from the nose side to the bonding side.
Figure 13:
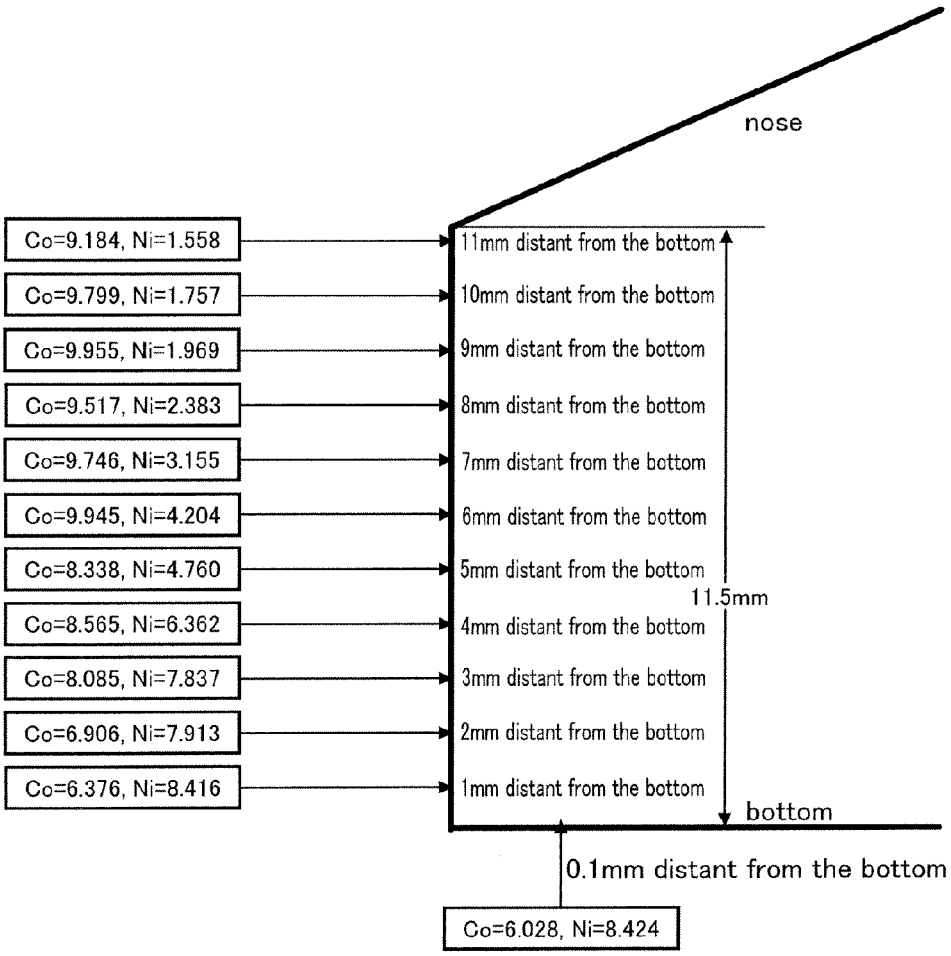
FIG. 13 is a view showing cobalt concentration (percent by weight) and nickel concentration (percent by weight) at various parts of the outer circumference of the major cutting edge of a cutting edge tip as further another embodiment of the present invention from the bottom to the nose.

FIG. 12 is a view showing the concentration distribution of component elements of the cutting edge tip obtained as described above from the sharp tip (the nose side) to the bottom (the bonding side) which was measured by a scanning electron microscope. The following table 1 shows the distance from the bottom at various parts of the outer circumference of the major cutting edge of the cutting edge tip 9 and cobalt concentration (percent by weight), nickel concentration (percent by weight) and Rockwell hardness (HRA) thereof. FIG. 13 is a view showing cobalt concentration (percent by weight) and nickel concentration (percent by weight) extracted from Table 1.

As shown in FIG. 12, nickel shows a gradient chemical composition where the content is increased from the nose side to the bonding side. But, as shown in table 1, the nickel content is more than 1.5 percent by weight at 11 mm distant from the bottom (the point extremely near the nose, see FIG. 13) and it can be recognized that nickel diffuses toward the nose.

TABLE 1

| the distance from | content (percent by weight) | | | Hardness |
|---|---|---|---|---|
| the bottom (mm) | Co | Ni | the sum of Co and Ni | (HRA) |
| 0.1 | 6.028 | 8.424 | 14.452 | 86.3 |
| 1 | 6.376 | 8.416 | 14.792 | 85.9 |
| 2 | 6.906 | 7.913 | 14.819 | 85.7 |
| 3 | 8.085 | 7.837 | 15.592 | 85.8 |
| 4 | 8.565 | 6.362 | 14.927 | 86.1 |
| 5 | 8.338 | 4.760 | 13.098 | 86.8 |
| 6 | 9.945 | 4.204 | 14.149 | 86.7 |
| 7 | 9.746 | 3.155 | 12.901 | 87.0 |
| 8 | 9.517 | 2.383 | 11.900 | 87.8 |
| 9 | 9.955 | 1.969 | 11.924 | 87.8 |
| 10 | 9.799 | 1.757 | 11.566 | 87.5 |
| 11 | 9.184 | 1.558 | 10.742 | 87.9 |

Thus, since nickel diffuses toward the nose by sintering at the temperature over the melting point of nickel, the hardness of the nose side tends to lower.

(4) The Fourth Embodiment

Figure 14:
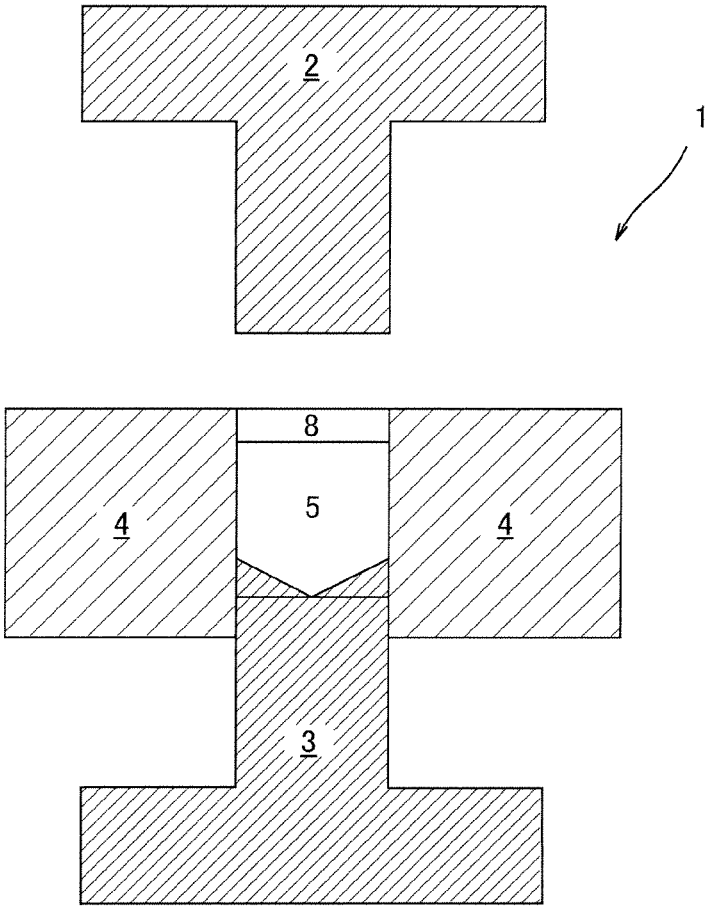
FIG. 14 is a schematic section view showing another example of a compacting mold for the hard tip and a layered compact.

The powder comprising WC (tungsten carbide) powder of 92 percent by weight of the average particle diameter of 0.9 μm and Co (cobalt) powder of 8 percent by weight of the average particle diameter of 1.25 μm was uniformly mixed to get a first mixed powder for a nose layer. As shown in FIG. 14, the first mixed powder was fed into the compacting mold 1 consisting of the upper punch 2, the lower punch 3 and the die 4 to obtain a nose layer 5. Next, the powder comprising WC—Co powder of 95 percent by weight consisting of the above WC powder of 92 parts by weight and the above Co powder of 8 parts by weight and Cr (chromium) powder of 5 percent by weight of the average particle diameter of 10.0 μm was uniformly mixed to get a second mixed powder for a bonding layer. The second mixed powder was layered upon the nose layer 5 to obtain a bonding layer 8. The layered article comprising the nose layer 5 and the bonding layer 8 was added pressure by the upper punch 2 from above to produce a layered compact whose chemical composition is gradient along the direction of height. As described above, the layered compact was produced.

Next, the above layered compact was put in a vacuum heating furnace (not shown). The pressure in the vacuum heating furnace was reduced to 200 Pa and heated up to the temperature of 1400° C. The layered compact was sintered at the temperature of 1400° C. for 40 minutes and the pressure of 200 Pa. The vacuum sintering was carried out like this. The heating was carried out under nitrogen gas condition to prevent the oxidation of the material.

Figure 15:
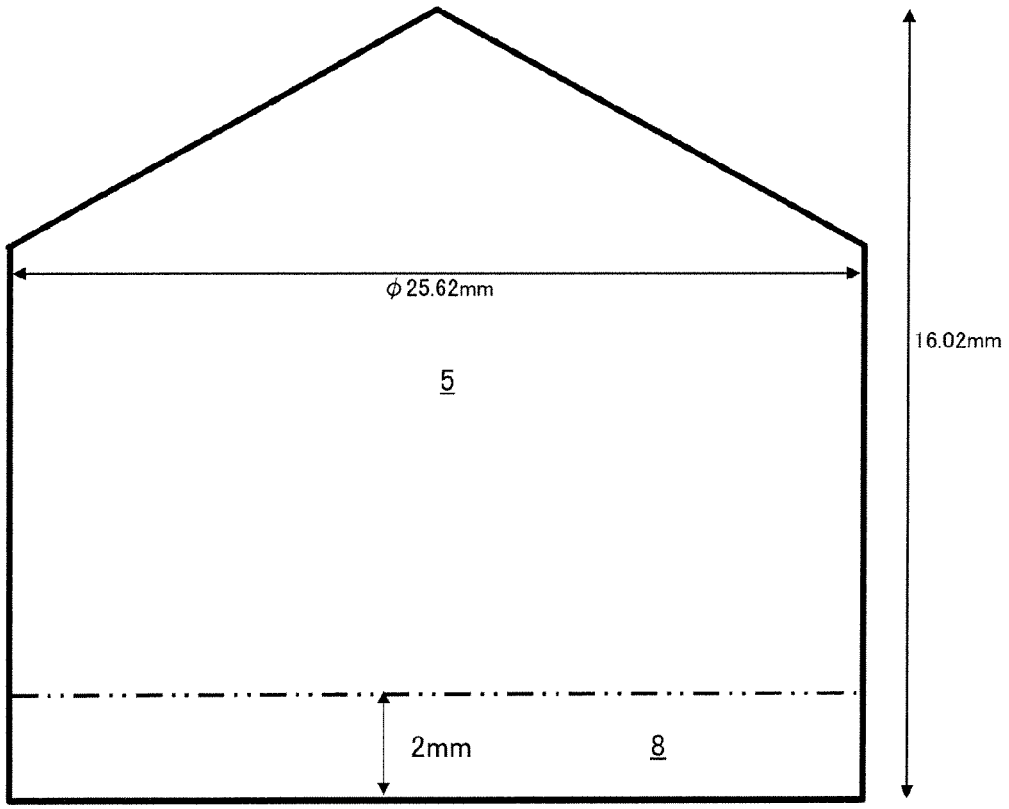
FIG. 15 is a schematic view showing the thickness of each layer of a cutting edge tip as still further another embodiment of the present invention.
Figure 16:
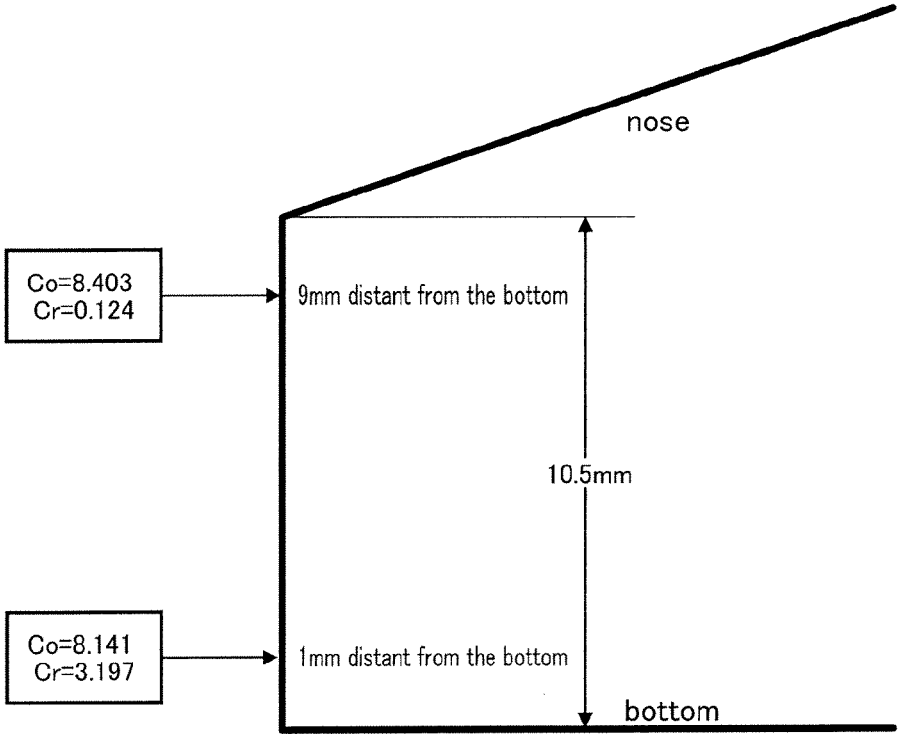
FIG. 16 is a view showing cobalt concentration (percent by weight) and nickel concentration (percent by weight) at a portion near the bottom and another portion near the nose of the outer circumference of the major cutting edge of a cutting edge tip as still further another embodiment of the present invention.

A cutting edge tip 9 as shown in FIG. 3 was obtained by the above vacuum sintering. FIG. 15 is a schematic view showing the thickness of each layer of the cutting edge tip 9 obtained as described above. FIG. 16 is a view showing cobalt concentration (percent by weight) and nickel concentration (percent by weight) at a portion near the bottom and another portion near the nose of the outer circumference of the major cutting edge of the cutting edge tip 9 obtained as described above.

Figure 17:
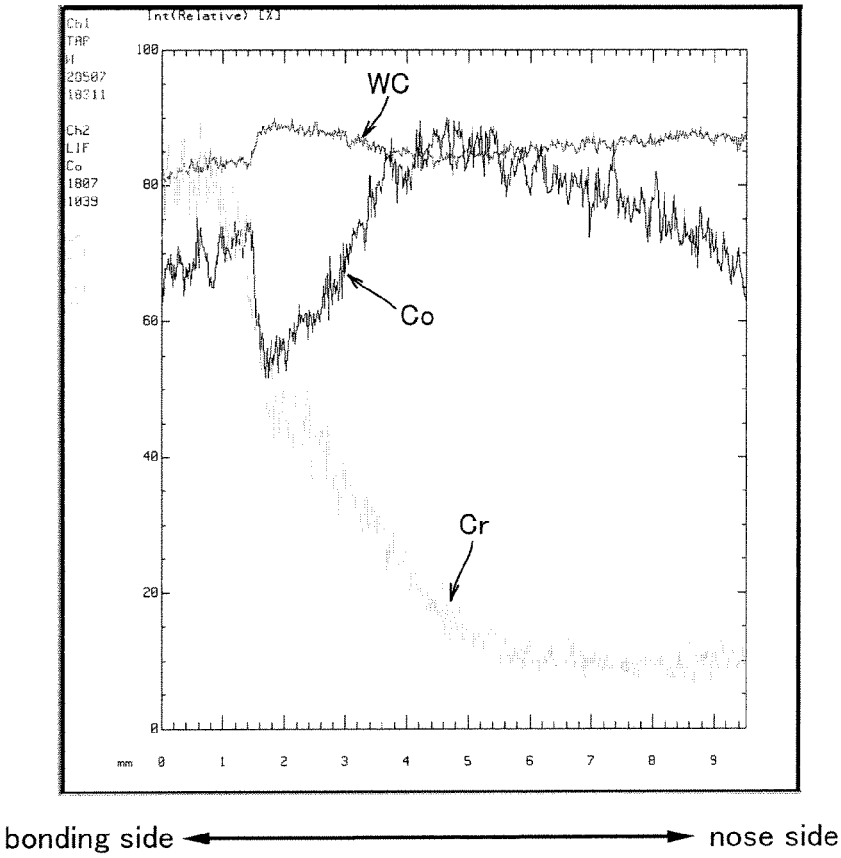
FIG. 17 is a view showing the concentration distribution of component elements of a cutting edge tip as still further another embodiment of the present invention from the nose side to the bonding side.

FIG. 17 is a view showing the concentration distribution of component elements of the cutting edge tip obtained as described above from the sharp tip (the nose side) to the bottom (the bonding side) which was measured by a scanning electron microscope. The content of tungsten carbide (WC) does not so much change from the bonding side to the nose side. Chromium (Cr) shows a gradient chemical composition where the content is increased from the nose side to the bonding side. The content of cobalt (Co) widely changes from the nose side to the bonding side.

Figure 18:
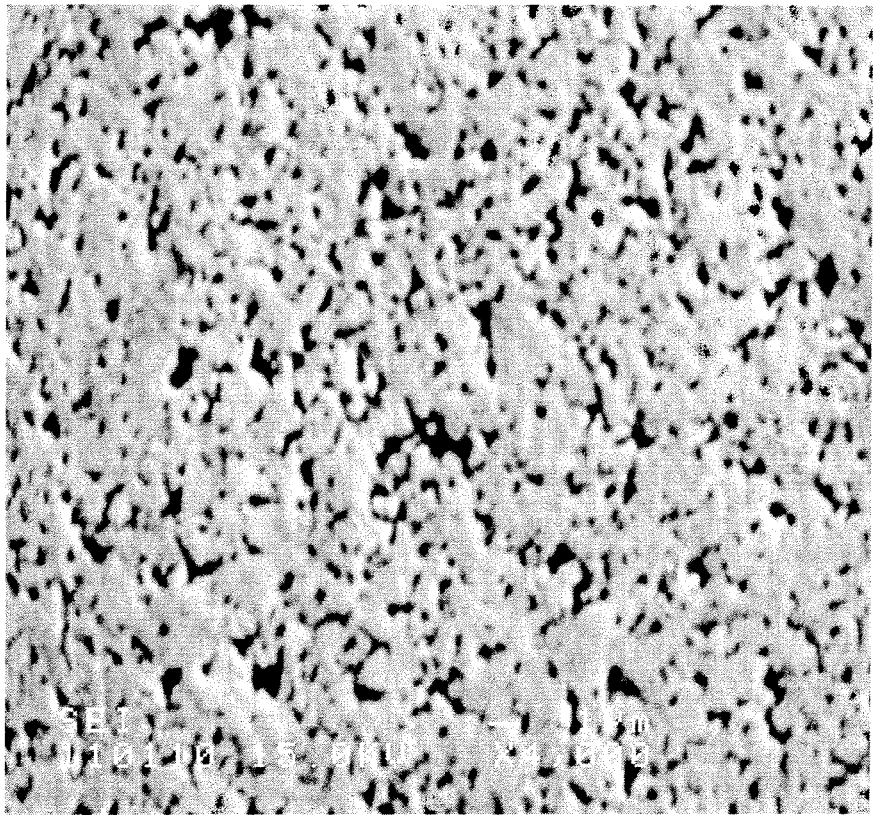
FIG. 18 is a view showing a microscope photo of the nose side of a cutting edge tip as still further another embodiment of the present invention.
Figure 19:
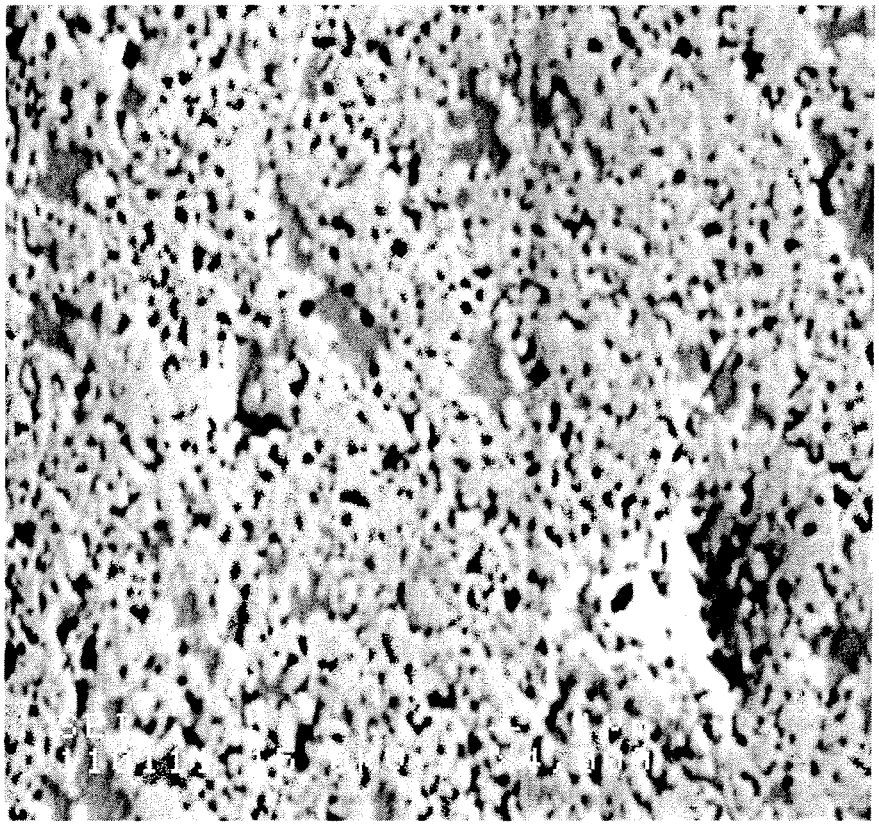
FIG. 19 is a view showing a microscope photo of the bonding side of a cutting edge tip as still further another embodiment of the present invention.

FIG. 18 is a view showing a 4000-power microscope photo of the nose side of the cutting edge tip obtained as described above. FIG. 19 is a view showing a 4000-power microscope photo of the bonding side of the cutting edge tip obtained as described above. It is recognized that the texture of the bonding side shown in FIG. 19 is reduced (becoming minute) in comparison with the texture of the nose side shown in FIG. 18. The sum (11.338 percent by weight, see FIG. 16) of content of cobalt and chromium at the bonding side corresponding to the above microscope photo outnumbers the sum (8.527 percent by weight, see FIG. 16) of content of cobalt and chromium at the nose side corresponding to the above microscope photo. But, Rockwell hardness (HRA) at the nose side was 90.6 and Rockwell hardness (HRA) at the bonding side was 92.0 corresponding to the upper limit which Rockwell hardness measuring instrument can read. Accordingly, it is considered that the real Rockwell hardness (HRA) at the bonding side is more than 92.0. Thus, in case chromium is added as a bonding metal, the chemical composition is gradient, but it can be recognized that the texture is made fine by sintering and the hardness tends to be increased.

(5) The Fifth Embodiment

FIG. 1 is a front view showing the important part of a drill bit whose part is omitted, wherein a cutting edge tip 9 obtained as described above was bonded to a main part 14 of bit by resistance welding.

(6) The Sixth Embodiment

Figure 20:
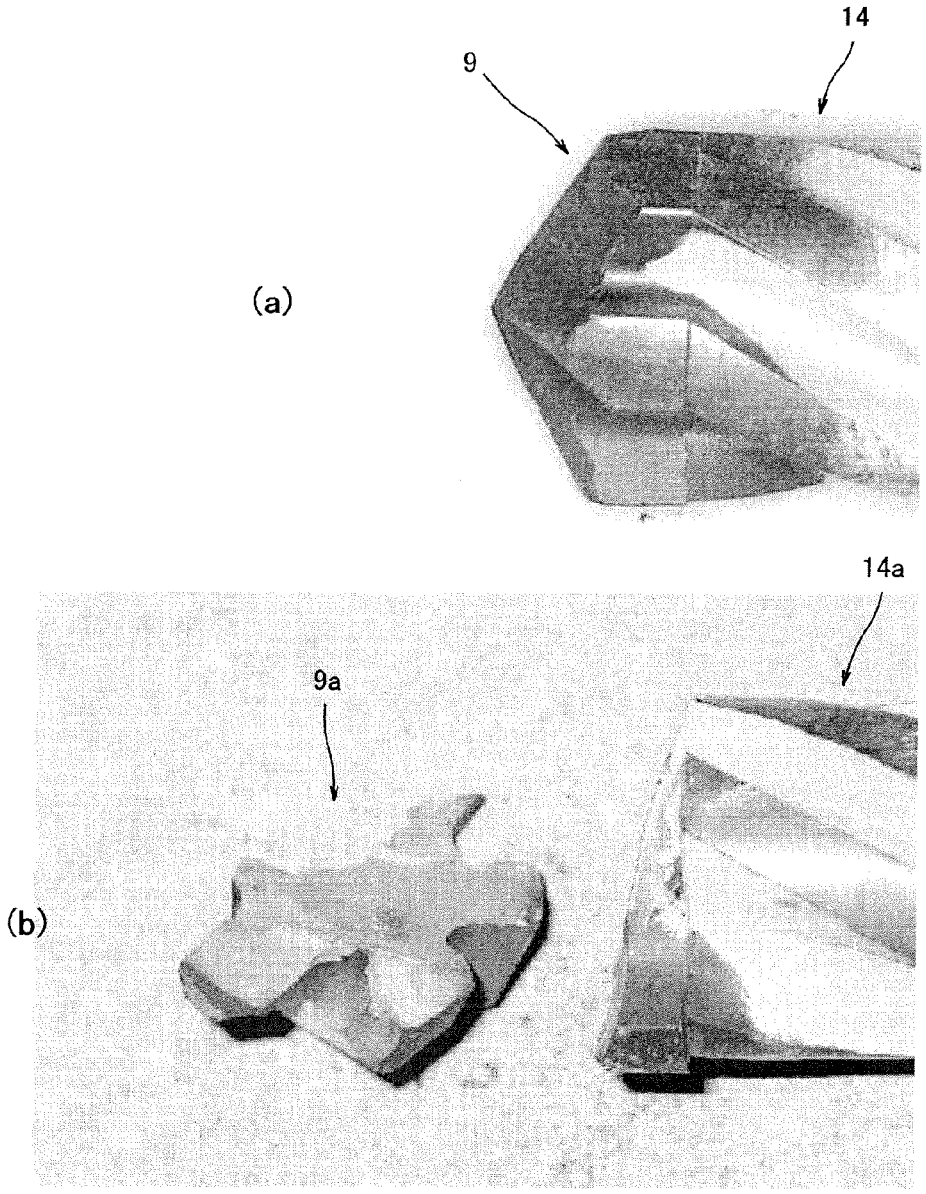
FIG. 20(*a*) is a view showing a photo of the external appearance of a drill bit, wherein a cutting edge tip as an embodiment of the hard tip of the present invention was bonded to the end and subjected to an actual use for ten hours, and FIG. 20(*b*) is a view showing a photo of the external appearance of a drill bit, wherein a cutting edge tip as a contrast of a hard tip was bonded to the end and subjected to an actual use for ten hours.

FIG. 20(*a*) is a view showing an enlarged photo of the external appearance including the bonding part of a drill bit, wherein the cutting edge tip 9 obtained by the first embodiment was bonded to the main part 14 of drill bit made of chromium-molybdenum steel by resistance welding and subjected to the boring of concrete for ten hours. It can be recognized that the bonding part is not damaged after the actual use for ten hours, not to mention the time of bonding.

FIG. 20(*b*) is a view showing an enlarged photo of the external appearance of a drill bit, wherein a cutting edge tip as a contrast was bonded to the main part of drill bit and subjected to the boring of concrete. This cutting edge tip as the contrast was obtained as described below. The powder comprising WC (tungsten carbide) powder of 85 percent by weight of the average particle diameter of 0.2 μm and Co (cobalt) powder of 15 percent by weight of the average particle diameter of 1.25 μm was uniformly mixed to get a mixed powder. The mixed powder was fed into the compacting mold 1 having a section as shown in FIG. 2. A compact was obtained by the same process as described above. Next, the compact was put in a vacuum heating furnace (not shown). The pressure in the vacuum heating furnace (nitrogen gas condition) was reduced to 200 Pa and heated up to the temperature of 1400° C. The compact was sintered at the temperature of 1400° C. for 40 minutes and the pressure of 200 Pa. The vacuum sintering was carried out like this.

The cutting edge tip 9*a* as the contrast was bonded to the main part 14*a* of drill bit made of chromium-molybdenum steel by resistance welding and subjected to the boring of concrete. The cutting edge tip 9*a* was not damaged at the time of bonding. But, at three hours after the beginning of boring, the cutting edge tip 9*a* came off the main part 14*a* of drill bit as shown in FIG. 20(*b*). This cutting edge tip as the contrast has the features that the chemical composition is not gradient, and a monolayer of nearly uniform chemical composition constitutes the cutting edge tip from the nose side to the bonding side, and the bonding side is not provided with toughness. On the other hand, a complex residual stress is created at the bonding part of the cutting edge tip and the main part of the drill bit because of the difference of coefficient of thermal expansion between the cutting edge tip and the main part of the drill bit having different chemical components each other. As a result, the cutting edge tip 9*a* came off the main part 14*a* of the drill bit by the complex residual stress.

INDUSTRIAL APPLICABILITY

The hard tip of the present invention is suitable for the material of the nose of various machining tools and cutting tools such as a drill bit, a tip saw, an weed cutting machine, a saw or the like.

The invention claimed is:

1. A method for producing a hard tip defining a nose side and a bonding side and comprising a block of a WC—Co sintered hard alloy and a nickel bonding metal, wherein a compounding ratio of WC to Co in the WC—Co sintered hard alloy is substantially the same at each layer from a nose layer of the nose side to a bonding layer of the bonding side via at least one intermediate layer, and a content of the bonding metal increases from the nose side to the bonding side, comprising:

(a) feeding sintered hard alloy powder for the nose layer containing a required compounding ratio of WC to Co and a first quantity of a bonding metal into a compacting mold for the hard tip, (b) layering sintered hard alloy powder for at least one intermediate layer comprising a required compounding ratio of WC to Co and the bonding metal whose content gradually increases compared with the nose layer upon the nose layer in the compacting mold for the hard tip, (c) layering sintered hard alloy powder for the bonding layer comprising a required compounding ratio of WC to Co and a second quantity of the bonding metal upon the intermediate layer(s) in the compacting mold for the hard tip and adding pressure to obtain a compact, the second quantity being larger than the first quantify, and (d) putting the compact in a heating furnace and sintering at a temperature at or below the melting point of the bonding metal and at a pressure lower than atmospheric pressure to produce the hard tip.

2. A method for producing a hard tip defining a nose side and a bonding side and comprising a block of a WC—Co sintered hard alloy and a nickel bonding metal, wherein a compounding ratio of WC to Co in the WC—Co sintered hard alloy is substantially the same at each layer from a nose layer of the nose side to a bonding layer of the bonding side, comprising:

(a) feeding sintered hard alloy powder for the nose layer comprising a required compounding ratio of WC to Co into a compacting mold for the hard tip, (b) layering sintered hard alloy powder for the bonding layer comprising a required compounding ratio of WC to Co and the bonding metal on the nose layer in the compacting mold for the hard tip with a content of the bonding metal increasing from the nose side to the bonding side, and adding pressure to obtain a compact, and (c) putting the compact in a heating furnace and sintering at a temperature at or below the melting point of the bonding metal and at a pressure lower than atmospheric pressure to produce the hard tip.

* * * * *